United States Patent [19]

Pendelton

[11] Patent Number: 4,688,415

[45] Date of Patent: Aug. 25, 1987

[54] METHOD OF MANUFACTURING METAL FASTENERS

[75] Inventor: Richard A. Pendelton, Brockton, Mass.

[73] Assignee: USM Corporation, Farmington, Conn.

[21] Appl. No.: 877,576

[22] Filed: Jun. 23, 1986

Related U.S. Application Data

[62] Division of Ser. No. 617,012, Jun. 4, 1984, abandoned.

[51] Int. Cl.[4] ..... B21D 28/08

[52] U.S. Cl. ..... 72/339; 72/335; 72/329; 72/324; 29/13; 402/14

[58] Field of Search ..... 72/339, 338, 335, 336, 72/330, 331, 324, 379, 329; 29/13; 402/14–18

[56] References Cited

U.S. PATENT DOCUMENTS

| | | | |
|---|---|---|---|
| 171,712 | 1/1876 | Adair | 402/14 |
| 185,457 | 12/1876 | Shinn | 402/14 |
| 210,885 | 12/1878 | Van Benschoten | 402/74 |
| 661,239 | 11/1900 | Ellis | 29/13 |
| 1,328,472 | 1/1920 | Affelder | 29/13 |
| 1,513,049 | 10/1924 | Krehbiel | 402/14 |
| 2,268,080 | 12/1941 | Novick | 29/13 |

FOREIGN PATENT DOCUMENTS

| | | | |
|---|---|---|---|
| 8357 | of 1907 | United Kingdom | 24/153 R |

OTHER PUBLICATIONS

"Progressive Die Slashes Tooling" from *American Machinist,* Apr. 8, 1948, pp. 86 and 87.

*Primary Examiner*—Daniel C. Crane
*Attorney, Agent, or Firm*—Thomas S. Szatkowski

[57] ABSTRACT

A metal fastener for a report folder and the method of manufacturing same comprising the steps of forming the fastener head, forming a single prong portion extending from the periphery of the head, and lancing the prong portion to form two separate prongs.

1 Claim, 6 Drawing Figures

METHOD OF MANUFACTURING METAL FASTENERS

This is a divisional of application Ser. No. 617,012, filed on June 4, 1984, now abandoned.

BACKGROUND OF THE INVENTION

1. Field of the Invention

A metal fastener for a report folder and the method of manufacturing same with the use of a minimum amount of material.

2. Summary of the Prior Art

There are metal fasteners for holding loose papers in a sandwiched fashion between the folds of a report folder. An illustration of such a report folder is shown in U. S. Pat. No. 964,189. The fastener itself has a head on one end and a pair of prongs on the opposite end that are adapted to be passed through openings in one fold of the binder, then through openings in the papers and an opposed opening in the opposite fold of the binder. The prongs are thereafter separated to lock the fastener against the folds of the binder to lock the papers between the folds to secure the papers in the binder. In one approach, the prongs of the fastener are formed from splitting a single piece of material extending from the head of the fastener. U. S. Pat. Nos. 185,457; 194,384; 199,085 and 208,836 illustrate this latter type of fastener.

Another approach to such a fastener having a head at one end and prongs at the opposite end, is to form one prong from the inner surface of the other prong. U. S. Pat. Nos. 607,447 and 1,513,049 illustrate this latter approach.

Still another type of fastener for report folders is the eyelet type in which the head end of the fastener is an eyelet secured to one fold of the binder with the prongs extending from the eyelet and adapted to be inserted into an opening in the opposite fold that is horizontally displaced from the eyelet head of the fastener. This latter type of fastener is discussed in detail hereinafter.

None of these prior art devices however comprise an eyelet type fastener formed of a single piece of flat stock with the eyelet head at one end and the prongs at the opposite end, with one prong being lanced out of the surface of the other prong.

BRIEF SUMMARY OF THE INVENTION

It is the object of this invention to provide an eyelet type fastener for securing papers between the folds of a report folder, the fastener being formed from a single piece of flat stock and having an eyelet on one end with a sunburst flange adapted to be inserted into an opening in the fold and formed over against the fold to secure the fastener to the fold of the report folder. The opposite end of the fastener has a pair of prongs extending from the periphery of the head and lying in the same plane as the head of the fastener. One of the prongs is formed or lanced out of the surface of the other prong. The prongs are adapted to be inserted through the openings in papers and an offset eyelet opening in an opposite fold of the binder. The prongs are thereafter separated by lifting the one prong out of the surface of the other to lock the prongs against the opposite fold and secure the papers in the folder. The attachment of the fastener eyelet head to the opening in the first fold is accomplished by high speed automatic assembly equipment.

The method of manufacturing the aforementioned article is by a progressive punch and die metal stamping operation in which a metal strip is progressively passed between tooling having punches and dies with various configurations to form the part. This is accomplished by interdigitizing or placing the parts back to back in the metal strip to utilize a minimum of stock material while obtaining an optimum number of parts. Further, with this new method, some of the tooling can be eliminated and the tooling is easier to maintain and will have a longer operating life.

DESCRIPTION OF THE PREFERRED EMBODIMENT

Figure 1:
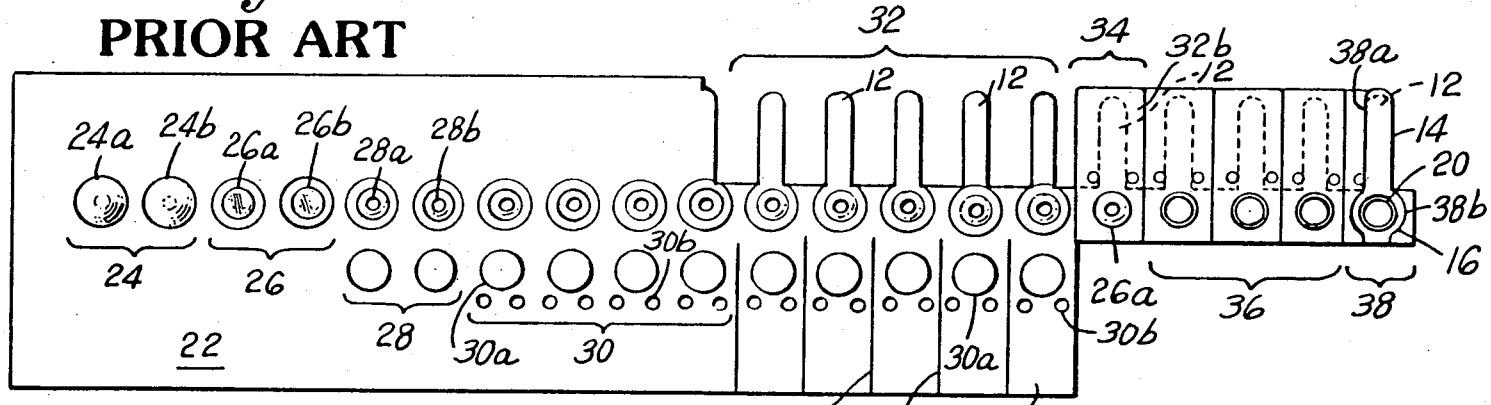
Fig. 1 PRIOR ART
FIG. 1 illustrates a metal strip in which the punch and die have performed various operations to form the conventional fastener.
Figure 2:
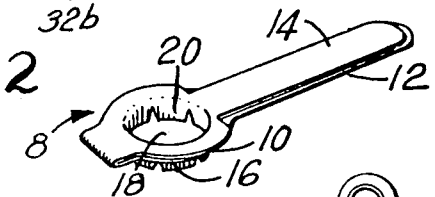
Fig 2 PRIOR ART
FIG. 2 illustrates the conventional fastener formed by the method illustrated in FIG. 1.

FIG. 1 illustrates the prior method of forming the conventional fastener 8 for a report folder. The fastener illustrated in FIG. 2 is a single piece of sheet stock 10 folded over to have two separate prongs 12 and 14. The head end 16 has an eyelet portion 18 with a sunburst 20 which is adapted to be inserted into an opening in a fold in the report folder. The sunburst portion 20 of eyelet 18 is folded over to lock the fastener to the folder (not shown). In use, the prongs 12, 14 are inserted into the openings in papers and through an opening in the opposite fold of the folders. The prongs are then separated to lock the papers between the folds.

This type of conventional fastener is formed by metal stamping by passing a strip 22 of sheet stock through a progressive punch and die metal stamping which in each stage of the stamping performs a separate operation on the sheet material. For example, as illustrated in FIG. 1, at stage 24, a pair of dimples 24(*a*), 24(*b*) are formed in the strip 22. These dimples are further formed out of the surface of the strip 22 at stage 26 as shown at 26(*a*) and 26(*b*). At the stage 28, openings 28(*a*) and 28(*b*) are formed in the strip 22 in dimples 26(*a*), 26(*b*). In the next stage 30, openings 30(*a*) are formed opposite dimples 26(*a*), 26(*b*) and relief openings 30(*b*) are formed adjacent the openings 30(*a*). In the next sequence 32, the prong 12 is stamped out of strip 22 and the strip 22 is lanced at 32(*a*) adjacent the openings 30(*a*). In the next stage 34, the material 32(*b*) left between lances 32(*a*) is folded over onto the prong area 12 so that opening 30(*a*) overlaps dimples 26(*a*) or 26(*b*). Thereafter, in stage 36 the dimples 26(*a*) or 26(*b*) are formed into the sunburst 20 by forcing the dimple material through the openings 30(*a*). After the sunburst 20 is completed, the material 32(*b*) is lanced at 38(*b*) in stage 38 to form the prong 14 and lance at head end 38(*b*) and the finished part is removed from the strip 22.

In the above described method of forming the conventional fastener 8, a considerable amount of stock in between the prongs and about the head area of the fastener is scraped or lost in the stamping operation.

Figure 3:
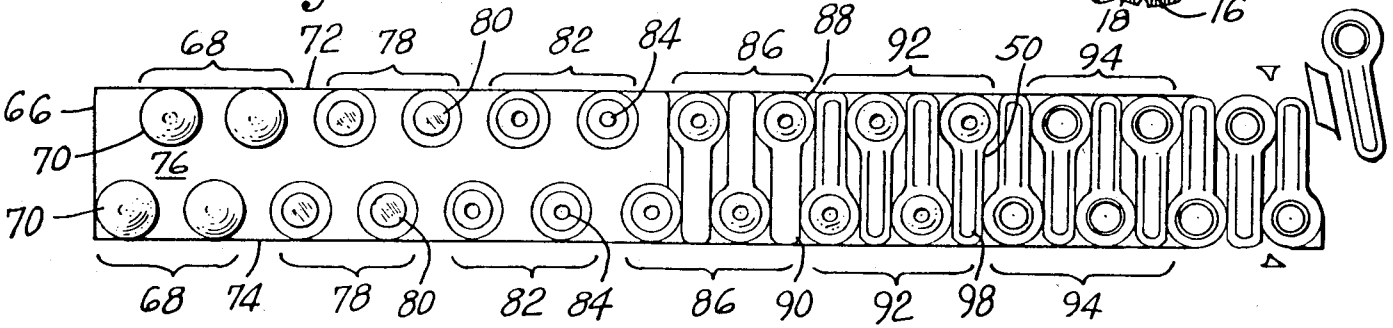
FIG. 3 illustrates a metal strip in which the punch and die have performed various operations in accordance with the new method.
Figure 4:
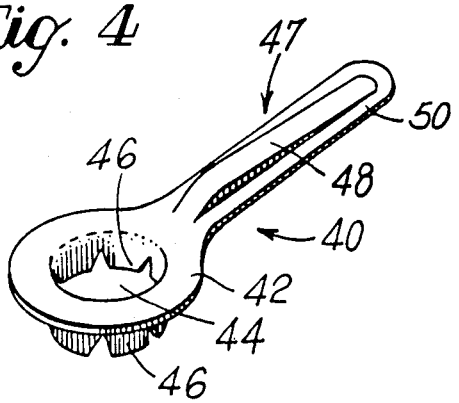
FIG. 4 is a perspective view of the novel metal fastener of this invention.

Attention is now directed to FIGS. 3 and 4 which illustrate the fastener of this invention and the simplified method of forming the fastener to utilize a minimum amount of stock to obtain an optimum number of parts.

The fastener 40 is formed from a flat strip and has an eyelet type head end 42 formed with an opening 44 having a sunburst 46. Also formed from the strip is a prong portion 47 extending from the pheriphery of the head end 42. The prong portion 47 is formed into a pair of prongs, one prong 48 being lanced out of the surface of the other prong 50.

Figure 5:
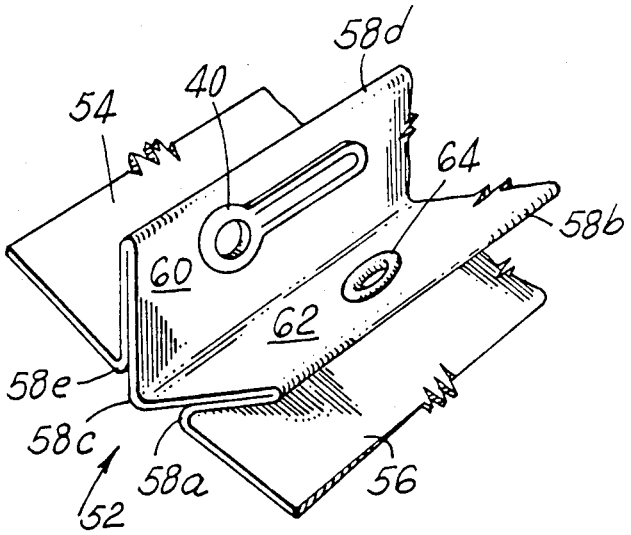
FIG. 5 is a perspective view showing the novel fastener attached to one fold of a report folder.

Attention is now directed to FIG. 5 which illustrates one use of the fastener 40 of this invention. A report folder 52 is formed from a single sheet of material and has a front face 54 and back face 56. The material is folded at five locations 58(*a*), (*b*), (*c*), (*d*), and (*e*) to form two upstanding double folds 60 and 62. The folds 60,62 extend the longitudinal extent of the folder and have openings (not shown). The sunburst 46 of the fastener 40 is adapted to be inserted in the opening in fold 60 and is formed over to secure the fastener 40 to fold 60. The opposite fold 62 has an eyelet 64 secured in the opening in the fold, the eyelet 64 is offset from the head end 42 of fastener 40. There may be several of the above described fastener, eyelet locations along the longitudinal extent of the folds 60,62 of the folder. The attachment of the sunburst 46 and, thus fastener 40, to the fold 60 is accomplished by high speed assembly equipment.

Figure 6:
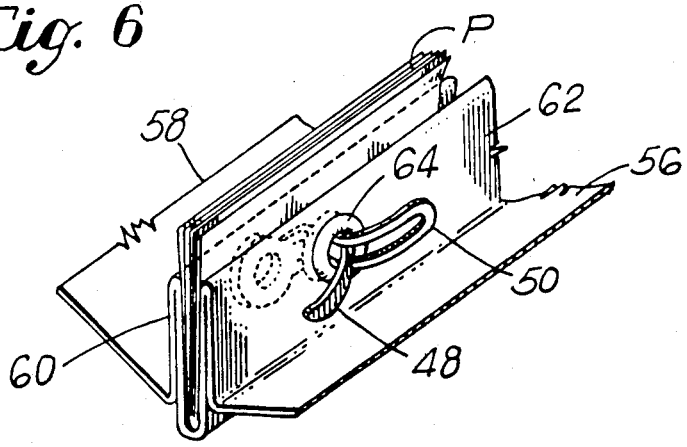
FIG. 6 is a perspective view illustrating the fastener securing papers between the folds of a report folder with fastener prongs being inserted into an offset eyelet opening in the opposed fold of the folder.

In use, papers (P) are positioned between folds 60 and 62. The prongs 48,50 are bent out of the plane of the fastener head end 42 and inserted through the openings (not shown) in the papers (P). The prongs 48,50 are then inserted through offset eyelet 64 in fold 62. Thereafter, the prongs 48,50 can be separated, as illustrated in FIG. 6, and folded against the backside of fold 62. In this fashion, the fastener 40 can sandwich the papers (P) between the folds 60 and 62 of the report folder 52.

Attention is now directed to FIG. 3 which illustrates the novel method of forming the fastener 40. A strip 66 of flat stock metal material is passed between progressive punches and dies which in various stages form the fastener with the use of a minimum of stock material. In stage 68, a dimple 70 is formed out of the surface of the strip. The dimples are offset from one another along the edges 72,74 of the strip to leave stock 76 in the area between the dimples 70. At the next stage 78, additional material 80 is formed out of the surface of the dimples 70. In the next stage 82, the openings 84 are formed in the material 80 to perform the sunburst 46, as will become apparent hereinafter. In stage 86, the outline of the head end 88 and prong end 90 of the fastener 40 are formed. In the next stage 92, the tine 48 is lanced out of the tine 50. In following stage 94, the opening 84 is punched through to form the completion of the sunburst 46. Thereafter, the fastener 40 is removed from he strip 66 leaving only the two small pieces 96,98 of scrap that result from this method of forming the fastener. By offsetting or laying the fastener's 40 back to back in the strip 66 and by forming prong 48 out of prong 50, a better than 50% material saving can be achieved over the conventional method of forming the fastener 8, previously described.

I claim:

1. The method of making a fastener from a sheet of material characterized by the steps of forming opposed offset circular openings in said material; forming opposed circular head end portions surrounding said openings; forming opposed offset elongated prong portions extending from the opposed periphery of said head end portions; lancing said prong portions to form inner and outer prongs; displacing said inner prong out of the plane of the surface of said outer prong to facilitate separation of said prongs; displacing the periphery of said circulr openings out of the surface of said material to form a sunburst; removing the stock between said opposed prong portions; and, removing said completed fastener from said material thereby forming each fastener with a circular head end portion having only one elongated prong portion extending therefrom.

* * * * *